US009066168B2

(12) United States Patent
Peitz et al.

(10) Patent No.: US 9,066,168 B2
(45) Date of Patent: Jun. 23, 2015

(54) SOUND GENERATOR FOR AN ANTI-NOISE SYSTEM FOR INFLUENCING EXHAUST NOISE AND/OR INTAKE NOISE OF A MOTOR VEHICLE

(71) Applicant: Eberspächer Exhaust Technology GmbH & Co. KG, Neunkirchen (DE)

(72) Inventors: Maximilian Peitz, Kirchheim unter Teck (DE); Steffen David, Schorndorf (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 0 days.

(21) Appl. No.: 14/332,984

(22) Filed: Jul. 16, 2014

(65) Prior Publication Data

US 2015/0020762 A1 Jan. 22, 2015

(30) Foreign Application Priority Data

Jul. 17, 2013 (DE) ..... 10 2013 011 937

(51) Int. Cl.
*F01N 1/06* (2006.01)
*H04R 1/00* (2006.01)
*G10K 9/18* (2006.01)
(Continued)

(52) U.S. Cl.
CPC *H04R 1/00* (2013.01); *F01N 1/065* (2013.01); *G10K 9/18* (2013.01); *G10K 11/1788* (2013.01); *G10K 2210/3212* (2013.01); *F02M 35/125* (2013.01)

(58) Field of Classification Search
CPC ... F02M 35/125; G10K 11/1788; G10K 9/18; G10K 2210/3212; F01N 1/065; H04R 1/00
USPC ..... 181/206; 381/71.1, 71.4
See application file for complete search history.

(56) References Cited

U.S. PATENT DOCUMENTS 4,177,874 A 12/1979 Angelini et al.
5,181,252 A 1/1993 Sapiejewski et al.
(Continued)

FOREIGN PATENT DOCUMENTS

CN 2 755 725 Y 2/2006
DE 197 51 596 A1 6/1999
(Continued)

OTHER PUBLICATIONS

Japanese Office Action of Oct. 28, 2014.

*Primary Examiner* — Jeremy Luks
(74) *Attorney, Agent, or Firm* — McGlew and Tuttle, P.C.

(57) ABSTRACT

A sound generator 103 for an anti-noise system for influencing sound waves propagating in exhaust systems or intake systems of vehicles driven by an internal combustion engine includes a loudspeaker basket 123, a membrane 122 supported by the loudspeaker basket 123, a permanent magnet 121 supported by the loudspeaker basket 123, a voice coil 126 supported by a voice coil carrier 125 and a membrane stop 150. The voice coil 126 is located within a constant magnetic field generated by the permanent magnet 121. The voice coil carrier 125 is supported by the membrane 122. The membrane stop 150 is located on the loudspeaker basket 123 adjacent to the membrane 122. The membrane stop 150 includes a projection 151 extending towards the membrane 122. An anti-noise system using the sound generator and a vehicle using the anti-noise system are also provided.

20 Claims, 4 Drawing Sheets

(51) Int. Cl.
*G10K 11/178* (2006.01)
*F02M 35/12* (2006.01)

(56) References Cited

U.S. PATENT DOCUMENTS

| | | | |
|---|---|---|---|
| 5,229,556 | A | 7/1993 | Geddes |
| 5,233,137 | A | 8/1993 | Geddes |
| 5,336,856 | A | 8/1994 | Krider et al. |
| 5,343,533 | A | 8/1994 | Geddes |
| 5,432,857 | A | 7/1995 | Geddes |
| 5,600,106 | A | 2/1997 | Langley |
| 5,619,020 | A | 4/1997 | Jones et al. |
| 5,703,337 | A | 12/1997 | Geisenberger |
| 2006/0037808 | A1 | 2/2006 | Krueger et al. |
| 2008/0053747 | A1 | 3/2008 | Krueger et al. |
| 2009/0255754 | A1 | 10/2009 | Kruger et al. |
| 2011/0000734 | A1 | 1/2011 | Krueger et al. |
| 2013/0013147 | A1 | 1/2013 | Luecking et al. |

FOREIGN PATENT DOCUMENTS

| | | | |
|---|---|---|---|
| DE | 10 2006 042 224 | B3 | 1/2008 |
| DE | 10 2008 018 085 | A1 | 10/2009 |
| DE | 10 2009 031 848 | A1 | 1/2011 |
| DE | 10 2011 106 647 | A1 | 1/2013 |
| EP | 0 373 188 | B1 | 6/1990 |
| EP | 0 674 097 | A1 | 9/1995 |
| EP | 0 755 045 | A2 | 1/1997 |
| EP | 0 916 817 | A2 | 5/1999 |
| EP | 1 055 804 | A1 | 11/2000 |
| EP | 1 515 583 | A1 | 3/2005 |
| EP | 1 627 996 | A1 | 2/2006 |
| EP | 2 108 791 | A1 | 10/2009 |
| JP | H0170491 | | 5/1989 |
| JP | H0380799 | A | 4/1991 |
| JP | H04104119 | U | 9/1992 |

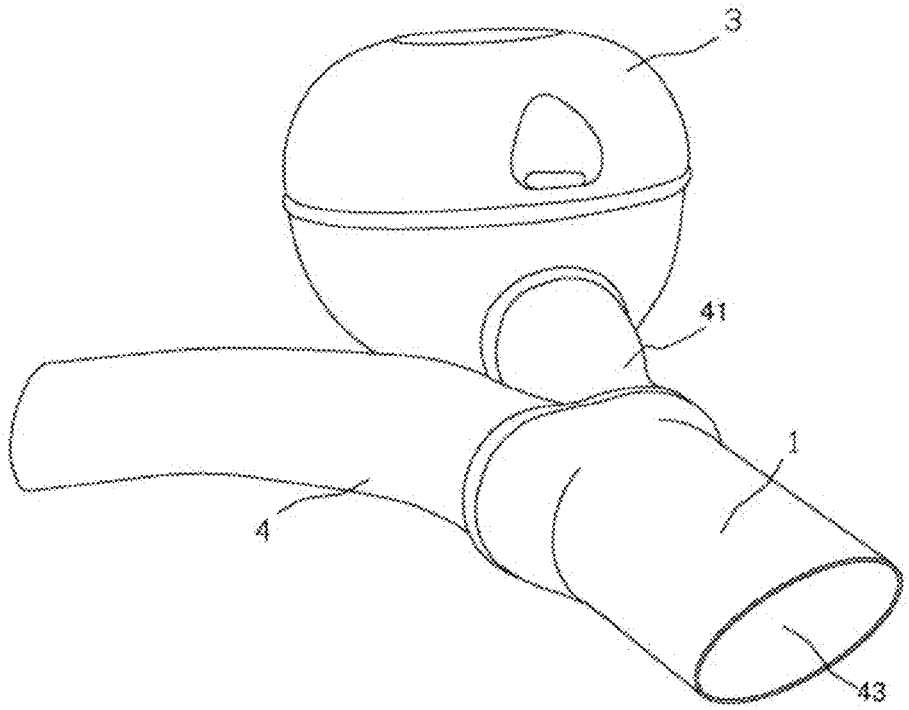
Fig. 1 - Prior art
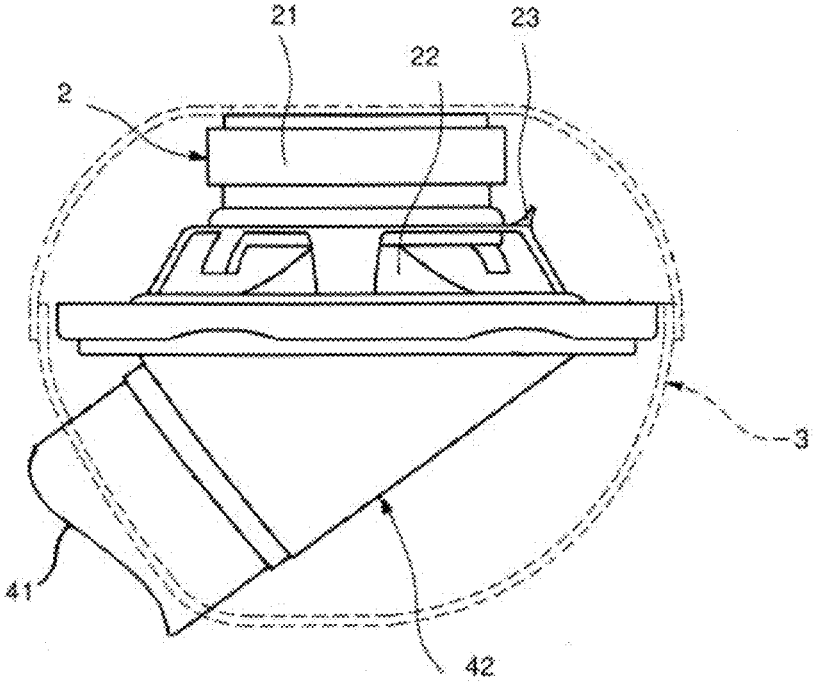
Fig. 2 - Prior art

SOUND GENERATOR FOR AN ANTI-NOISE SYSTEM FOR INFLUENCING EXHAUST NOISE AND/OR INTAKE NOISE OF A MOTOR VEHICLE

CROSS REFERENCE TO RELATED APPLICATIONS

This present application claims priority of Patent Application DE 10 2013 011 937.5, filed Jul. 17, 2013 in Germany, the entire contents of which are incorporated by reference herein.

FIELD OF THE INVENTION

The present invention concerns a sound generator for an anti-noise system for influencing sound propagating through exhaust systems of vehicles driven by internal combustion engines (exhaust noise), and/or for influencing sound propagating through intake systems of internal combustion engines (intake noise).

BACKGROUND OF THE INVENTION

Regardless of the type of internal combustion engine (for example reciprocating piston engine, pistonless rotary engine or free-piston engine), noises are generated as a result of the successively executed strokes (in particular intake and compression of the fuel-air mixture, combustion and discharge of the combusted fuel-air mixture). On the one hand, the noises propagate through the internal combustion engine in the form of solid-borne sound and are emitted on the outside of the internal combustion engine in the form of airborne sound. On the other hand, the noises propagate in the form of airborne sound together with the combusted fuel-air mixture through an exhaust system that is in fluid communication with the internal combustion engine.

These noises are often regarded as being disadvantageous. On the one hand, there are statutory provisions on protection against noise to be observed by manufacturers of vehicles driven by internal combustion engines. These statutory provisions normally specify a maximum sound pressure for an operation of a vehicle. Manufacturers, on the other hand, try to impart a characteristic noise emission to an internal combustion engine driven vehicles of their production, with the noise emission fitting the image of the respective manufacturer and being popular with customers. Present-day engines with small displacement often cannot naturally generate such intended characteristic noise.

The noises propagating through the internal combustion engine in the form of solid-borne sound can be muffled quite well and are thus usually no problem as far as protection against noise is concerned.

The noises traveling together with the combusted fuel-air mixture in the form of airborne sound through the exhaust system of the internal combustion engine are reduced by exhaust mufflers located ahead of the exhaust system discharge opening (usually a tailpipe) and downstream of catalytic converters, if present. Respective mufflers may for instance work according to the absorption and/or reflection principle. The disadvantage of both operating principles is that they require a comparatively large volume and create a comparatively high resistance to the combusted fuel-air mixture, resulting in a drop of the overall efficiency of the vehicle and in increased fuel consumption.

For quite some time, so-called anti-noise systems have been developed as an alternative or supplement to mufflers, which superimpose electro-acoustically generated anti-noise on airborne noise generated by the internal combustion engine and propagated through the exhaust system. Respective systems are for instance known from the following documents: U.S. Pat. No. 4,177,874; U.S. Pat. No. 5,229,556; U.S. Pat. No. 5,233,137; U.S. Pat. No. 5,343,533; U.S. Pat. No. 5,336,856; U.S. Pat. No. 5,432,857; U.S. Pat. No. 5,600,106; U.S. Pat. No. 5,619,020; EP 0 373 188; EP 0 674 097; EP 0 755 045; EP 0 916 817; EP 1 055 804; EP 1 627 996; DE 197 51 596; DE 10 2006 042 224; DE 10 2008 018 085; and DE 10 2009 031 848.

Respective anti-noise systems typically use a so-called Filtered-X, Least Mean Squares (FxLMS) algorithm trying to bring the airborne noise propagating through the exhaust system down to zero (in the case of noise-cancellation) or to a preset threshold (in the case of influencing noise) by outputting sound using at least one loudspeaker being in fluid communication with the exhaust system. For achieving a completely destructive interference between the sound waves of the airborne sound propagating through the exhaust system and the anti-noise generated by the loudspeaker, the sound waves originating from the loudspeaker have to match the sound waves propagating through the exhaust system in amplitude and frequency with a relative phase shift of 180 degrees. If the anti-noise sound waves generated at the loudspeaker match the sound waves of the airborne noise propagating through the exhaust system in frequency and have a phase shift of 180 degrees relative thereto, but do not match the sound waves in amplitude, only an attenuation of the sound waves of the airborne sound propagating through the exhaust system results. The anti-noise is calculated separately for each frequency band of the airborne noise propagating through the exhaust pipe using the FxLMS-algorithm by determining a proper frequency and phasing of two sine oscillations being shifted with respect to each other by 90 degrees, and by calculating the required amplitudes for these sine oscillations. The objective of anti-noise systems is that the cancellation or influencing of sound at least outside of, but, as the case may be, also inside the exhaust system, is audible and measurable. The term "anti-noise" used in this document serves to distinguish airborne sound generated as a result of the successively executed strokes of the combustion engine and propagated in the exhaust system from airborne sound generated by the anti-noise system and propagated in the exhaust system. In itself anti-noise is just plain airborne sound. It is pointed out that the present invention is not limited to the use of an FxLMS algorithm.

Sound waves also occur in intake systems of internal combustion engines, which may be regarded as annoying. These sound waves are caused by both turbulences in the flow of air and the internal combustion engine itself. The intake system, also called induction tract, includes all combustion air guiding components of an internal combustion engine located ahead of the combustion chamber or combustion space.

An anti-noise system for influencing sound waves propagating through an exhaust system of a vehicle driven by an internal combustion engine is already known from document EP 2 108 791 A1 and is explained below with reference to FIGS. 1 and 2.

The anti-noise system shown in the schematic perspective view of FIG. 1 includes a sound generator 3 in the form of a rigid enclosure comprising an electrodynamic loudspeaker 2 and being connected to an exhaust system 4 by a Y-pipe 1. The Y-pipe 1 comprises a discharge opening 5 at the base of the "Y" for discharging exhaust gases flowing through the exhaust system 4. By having the connection implemented with the Y-pipe, the thermal stress of the loudspeaker 2 disposed within the sound generator 3 that is caused by the exhaust gases flowing through the exhaust system 4 is kept low. This is required because conventional loudspeakers are configured for an operation within a range of up to a maximum of 200° C. only, while the temperature of the exhaust gases flowing through the exhaust system 4 may be up to between 400° C. and 700° C.

FIG. 2 shows a schematic cross section through a sound generator 3 using the example of a voice coil loudspeaker. As can be seen, the loudspeaker 2 comprises a permanent magnet 21 and a funnel-like membrane 22 which are both supported by a loudspeaker basket 23. Hereby, the membrane 22 is connected at its radial outside to the loudspeaker basket 23 by an elastic surround (not shown) and comprises at its radial inside a voice coil (not shown) that moves in a bore in the permanent magnet 21. By applying an alternating current to the voice coil, a Lorentz force is exerted onto the membrane 22 by the voice coil causing the membrane 22 to oscillate. The loudspeaker basket 23 is at its radial outside supported by a bell mouth 42 that is connected to the Y-pipe 1 via a connecting pipe 41. The use of bell mouth 42 is required in this prior art document, since the area of the loudspeaker's 2 membrane 22 is larger than the cross-sectional area of the exhaust system 4 in the sound coupling region. This is necessary in this prior art document to achieve the required sound energy flux.

With the above arrangement, there is a risk of the membrane and/or the voice coil being subject to mechanical damage due to an excessive displacement of the membrane and the voice coil supported by the membrane. This may be caused by external influences like for instance an immersion of the discharge opening (e.g. tailpipe) of the exhaust system in water or a clogging of the exhaust system with, for example, insulating material of a passive muffler. Also, for example, a high ambient air pressure may result in a formation of negative pressure inside the sound generator at the side facing away from the bell mouth altering the oscillation characteristics of the membrane and biasing it towards the permanent magnet. Finally, also a control signal used for operating the loudspeaker may cause an excessive displacement of the membrane, for example, when the control signal is not well enough adapted to the loudspeaker used, or when the control signal stimulates a self-resonance of the loudspeaker.

SUMMARY OF THE INVENTION

Embodiments of the present invention provide a sound generator for an anti-noise system for influencing exhaust noises or intake noises of vehicles driven by internal combustion engines, that is robust to an excessive displacement of the membrane.

Embodiments of a sound generator for an anti-noise system for influencing sound propagating through exhaust systems or intake systems of vehicles driven by internal combustion engines comprise a loudspeaker basket, a membrane supported by the loudspeaker basket, a permanent magnet supported by the loudspeaker basket, a voice coil supported by a voice coil carrier, and a membrane stop. The membrane stop provides a fixed limit stop for the membrane. The voice coil is disposed in a constant magnetic field created by the permanent magnet and is supported by the membrane. The membrane stop comprises at least one projection extending towards the membrane and being spaced apart from the membrane when the membrane is in its rest position. This prevents an excessive displacement of the membrane and thus of the voice coil by the at least one projection of the membrane stop abutting against a portion of the membrane.

According to an embodiment, the at least one projection of the membrane stop comprises at least one contact surface facing the membrane. In case of a membrane stop comprising plural projections each of the projections of the membrane stop comprises at least one contact surface facing the membrane. The sum total of the contact surfaces of all projections of the membrane stop thereby include a surface area facing the membrane that amounts to more than 2 percent and less than 15 percent of the membrane's surface area, or to more than 4 percent and less than 10 percent of the surface area of the membrane, or to between 7 percent and 9 percent of the surface area of the membrane. A respective dimensioning of the contact surfaces of the membrane stop's projections ensures that the force acting on the membrane when hitting the contact surfaces is distributed over a membrane surface large enough to avoid damage to the membrane with high probability. Furthermore, the respective dimensioning of the contact surfaces of the membrane stop's projections ensures that adverse effects to air flowing between the loudspeaker basket and the membrane, and thus to the acoustic characteristics of the sound generator, are avoided to a great extent.

According to an embodiment, the contact surfaces of all projections of the membrane stop each have, starting from the permanent magnet, a larger extension in the radial direction than in the circumferential direction. Particularly in an axial top view on the permanent magnet and the membrane stop surrounding it, the contact surfaces of all projections of the membrane stop may extend in radial directions. Respective orientations of the contact surfaces allow to further reduce disturbances of the air flowing between the membrane and the loudspeaker basket and thus to further reduce adverse effects on the acoustic characteristics of the sound generator.

According to an embodiment, the at least one projection of the membrane stop comprises a contact surface facing the membrane. The distance of the contact surface of the at least one projection of the membrane stop to the membrane in its rest position is then substantially constant for the overall length of the contact surface of the respective projection and equal for all projections of the membrane stop. Tolerances of less than 5 percent, and in particular of less than 3 percent, and further in particular of less than 1 percent are, however, allowed for. This way, it is guaranteed that a force acting on the membrane when hitting the contact surfaces is distributed as evenly as possible on all contact surfaces and the whole of the surface area of the at least one projection facing the membrane.

According to an embodiment, the distance between the contact surface(s) of the at least one projection of the membrane stop facing the membrane and the membrane being in its rest position is at least 3 mm, or at least 6 mm, or at least 9 mm. Alternatively, the distance between the membrane in its rest position and the contact surface(s) of the at least one projection of the membrane stop facing the membrane is at least 2 percent, or at least 4 percent, or at least 6 percent of a maximum diameter (dimension) of the membrane. This way, the membrane will generally not hit the membrane stop during normal operation of the loudspeaker.

According to an embodiment, the membrane stop has an open inner diameter (dimension) that is larger than a maximum diameter (dimension) of the voice coil carrier. Thus, the at least one contact surface of the at least one projection of the membrane stop facing the membrane is located outside of a dome usually covering the voice coil. This way a collision of the voice coil carrier with the membrane stop is prevented.

According to an embodiment, the membrane stop has a maximum outer diameter (dimension) smaller than a maximum diameter of the membrane.

According to an embodiment, the membrane stop comprises a plurality of spaced apart projections disposed over an angular range of 360° around the permanent magnet. This configuration may be regular or irregular. Thus, the force acting on the membrane stop upon being hit by the membrane is distributed over a plurality of projections so that damage to the membrane as well as a tilting of the membrane in response to a localized and/or unbalanced load is prevented. In addition, also any disturbances of the air flowing between the membrane and the loudspeaker basket, and thus any impairment of the acoustic characteristics of the sound generator, are minimized by the skeletal structure of the membrane stop.

According to an embodiment, the membrane stop comprises at least four, and in particular at least sixteen, and further in particular at least twenty-four projections disposed over an angular range of 360° around the permanent magnet. This configuration may be regular or irregular. The higher the selected number of projections, the smaller can be the surface area of the at least one contact surface of each of the projections facing the membrane.

According to an embodiment, the at least one projection of the membrane stop has no sharp edge and/or radii smaller than 0.1 mm, or smaller than 0.5 mm, or smaller than 1 mm at its contact surface facing the membrane, in order to avoid damage to the membrane when hit.

According to an embodiment, the membrane stop comprises a first ring that is fixed to the loudspeaker basket concentrically with respect to the permanent magnet, and that supports the at least one projection. The first ring enables a force acting on the at least one projection to be conveyed uniformly to the loudspeaker basket.

According to an embodiment, the membrane stop comprises a second ring arranged concentrically with respect to the permanent magnet, supported by the at least one projection of the membrane stop (or by several or all projections of the membrane stop), and forming a stop limit for the membrane spaced apart from the loudspeaker basket. According to an embodiment, the maximum cross section of the second ring is smaller than 5 mm, or smaller than 3 mm.

According to an embodiment, the membrane stop is formed integrally with the loudspeaker basket. According to an alternative embodiment, the membrane stop is a separate component supported by the loudspeaker basket.

According to an embodiment, the membrane stop, the permanent magnet and the voice coil carrier are all located at the same side of the membrane. Thus, the membrane is not located in-between the permanent magnet and the membrane stop.

According to an embodiment, the membrane stop is formed in one piece from synthetic material or metal. According to an embodiment, the membrane stop is a cast part. According to an embodiment, the membrane stop is an injection molded part.

According to an embodiment, the membrane stop has a Shore-D hardness of between 50 and 95, or a Shore-D hardness of between 70 and 80. According to an embodiment, the membrane stop has a ball indenter hardness in the dry state according to DIN 53456 of between 130 MPa and 170 MPa.

According to an embodiment, the membrane stop is inelastic and thus rigid. According to an embodiment, the membrane stop has a Young's modulus of more than 0.2 GPa or more than 1 GPa or more than 10 GPa. According to an embodiment, the membrane stop has a shear modulus of more than 0.05 GPa or more than 0.1 GPa or more than 10 Gpa.

According to an embodiment, the membrane is funnel-like, and in particular non developable funnel-like (NAWI membrane) or dome-like, with the top or top face of the funnel-like membrane or the geometric center of the dome-like membrane facing towards the permanent magnet. The base area of the funnel-like or dome-like membrane thus faces away from the permanent magnet. Hence, the distance between the top or top face of the funnel-like membrane or the geometric center of the dome-like membrane is spaced apart from the permanent magnet less than the respective base area of the membrane. Non-developable funnel-like or dome-like membranes are particularly rigid and therefore enable a full-area and uniform movement of the membrane. Alternatively, also a cone-like membrane may for instance be used. According to an embodiment, the membrane has rotational symmetry with an axial extent, from a membrane base to a membrane top, and with a base radial dimension that is larger than a top radial dimension with the membrane base being spaced away, in an axial direction, from the permanent magnet a greater distance than the membrane top.

According to an embodiment, the membrane, being in particular air-tight, is coupled to the loudspeaker basket by a surround that is in particular air-tight.

According to an embodiment, the sound generator further comprises an enclosure (e.g. loudspeaker casing) supporting the loudspeaker basket.

According to an embodiment, the enclosure comprises a port opening for a fluid communication with an exhaust system or intake system, respectively.

According to an embodiment, the connection of the loudspeaker basket having the membrane attached thereon to the enclosure is effected in an air-tight manner. According to an embodiment, said connection with the enclosure is effected indirectly by a bell mouth attached to the enclosure in an air-tight manner. The membrane further divides an internal volume of the enclosure into a portion separated from the exhaust system or intake system and a portion being in fluid communication with the exhaust system or intake system, respectively, through the port opening.

Since only the membrane and as the case may be a periphery of the loudspeaker basket are located within the portion of the enclosure that is in fluid communication with the exhaust system or intake system through the port opening, only these are exposed to the hot exhaust gases contaminated with corrosive chemicals or to the possibly humid and/or polluted drawn in air. Accordingly, aside from the inside wall of the enclosure, only these elements have to be made from a material resistant to the exhaust gases and a possibly formed condensate or the humidity and the harmful substances of the drawn in air. The other elements of the sound generator, and in particular the sensitive voice coil being due to ohmic losses already exposed to a certain thermal stress, are, however, protected from the exhaust gases or drawn in air by the membrane and the inside wall of the enclosure. The risk of a short circuiting of the voice coil by condensate formed from the exhaust gases or humidity of the drawn in air is thereby also reduced.

According to an embodiment, the enclosure is air-tight, except for the port opening.

According to an embodiment, the loudspeaker basket supports a centering device connected to the voice coil carrier or to the membrane in the region of the voice coil carrier. The centering device ensures the return of the membrane to its rest position and the centering of the voice coil with respect to the permanent magnet. It is noted that the provision of a centering device is not necessary when a substantially frictionless guidance of the voice coil in the permanent magnet is effected.

According to an embodiment, the loudspeaker basket is made from metal or synthetic material.

According to an embodiment, the enclosure of the sound generator is made from metal or synthetic material.

According to an embodiment, the enclosure of the sound generator is formed by two cup-shaped shells that are soldered together, welded together, beaded together, riveted together, adhesively bonded together, or screwed together in an air-tight manner.

According to an embodiment, the membrane is made of metal, and in particular of aluminum or titanium, or of synthetic material, and in particular of aromatic polyamides.

According to an embodiment, the permanent magnet comprises rare earths, and in particular neodymium, and is in particular formed from a neodymium-iron-boron alloy.

Embodiments of an anti-noise system for exhaust systems and/or intake systems of a vehicle driven by an internal combustion engine comprise an anti-noise controller and at least one sound generator as described above. The voice coil of the at least one sound generator is hereby electrically connected with the anti-noise controller. The anti-noise controller is configured to generate a control signal and to output the control signal to the voice coil of the at least one sound generator. The control signal is adapted to cancel noise inside the exhaust system or the intake system at least partially or preferably completely in magnitude and phase upon the voice coil of the at least one sound generator being operated with the control signal.

Embodiments of a motor vehicle comprise an internal combustion engine having an engine control unit, an intake system and an exhaust system, both in fluid communication with the internal combustion engine and the anti-noise system described above. The at least one sound generator of the anti-noise system is hereby in fluid communication with the intake system or the exhaust system. The anti-noise controller of the anti-noise system is further connected to the engine control unit of the internal combustion engine of the vehicle.

Further it is noted that the terms "including", "comprising", "containing", "having", and "with", as well as grammatical modifications thereof used in this specification and the claims for listing features, are generally to be considered to specify a non-exhaustive listing of features like for instance method steps, components, ranges, dimensions or the like, and do by no means preclude the presence or addition of one or more other features or groups of other or additional features. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

Further features of the invention will be apparent from the following description of exemplary embodiments together with the claims and the Figures. In the Figures, like or similar elements are designated as far as possible by alike or similar reference numerals. It is noted that the invention is not limited to the embodiments of the exemplary embodiments described, but is defined by the scope of the attached claims. In particular, embodiments according to the invention may implement individual features in a different number and combination than the examples provided below, whereby it is further noted that not all possible embodiments necessarily exhibit each and every, or any, of the advantages identified herein. Therefore, to understand the features of the individual components of a specific embodiment, the descriptions of other embodiments and of the summary of the disclosure should be referred to.

In the drawings:

FIG. 1 is a schematic representation of a perspective view of an anti-noise system according to the state-of-the-art;

FIG. 2 is a schematic representation showing a cross section through a sound generator of an anti-noise system according to the state-of-the-art;

DESCRIPTION OF THE PREFERRED EMBODIMENTS

Figure 3:
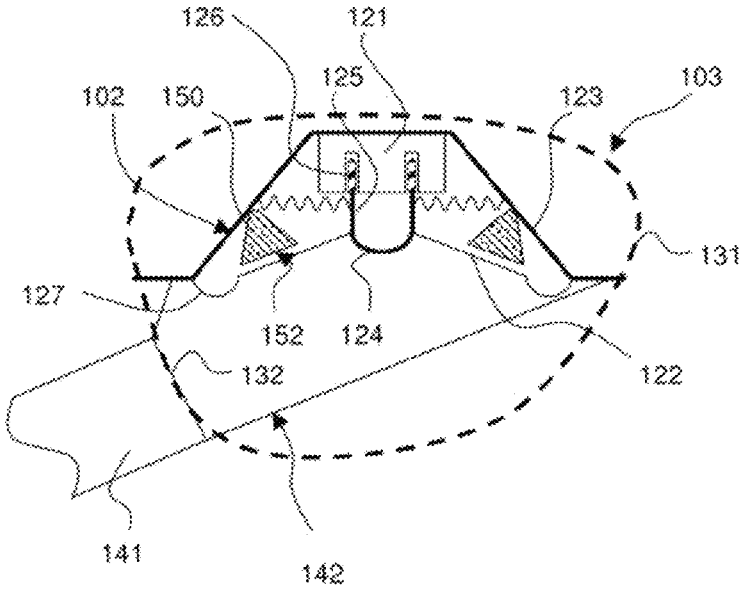
FIG. 3 is a schematic representation showing a cross section through a sound generator of an anti-noise system according to an embodiment of the invention.

The schematic representation of FIG. 3 shows a cross-sectional view through the sound generator 103 according to an embodiment of the invention.

The sound generator 103 comprises an enclosure 131 housing, in its interior, a voice coil loudspeaker 102. The loudspeaker 102 comprises a permanent magnet 121 made of a neodymium-iron-boron alloy and a cone-like membrane 122 made of synthetic material. Both the permanent magnet 121 and the cone-like membrane 122 are supported by a loudspeaker basket 123 made from a steel sheet. The cone-like membrane 122 is hereby at its base area at its radial outside connected to the loudspeaker basket 133 via an elastic surround 127 made of synthetic material. The synthetic material can be elastic. The cone-like membrane 122 has rotational symmetry with an axial extent, from a base area (membrane base) to a top face (membrane top), and with a base area radial dimension that is larger than a top area radial dimension. The top face of the cone-like membrane 122 is at its center capped by a cover cap 124. A voice coil carrier 125 supporting a voice coil 126 is fixed to the membrane 122 in the region of the cover cap 124. The voice coil 126 is disposed in a constant magnetic field created by a permanent magnet 121. The permanent magnet 121 comprises a corresponding opening for this purpose. The permanent magnet 121 may further comprise pole plates not shown in FIG. 3. When applying an alternating current to the voice coil 126, the voice coil 126 and the voice coil carrier 125 exert a force to the membrane 122 that is based on the Lorentz force, and causes an oscillation of the membrane 122.

The top face of the cone-like membrane 122 with the cover cap 124 faces towards the loudspeaker basket 123 and the permanent magnet 121. The base area of the cone-like membrane 122 faces away from the loudspeaker basket 123 and the permanent magnet 121. Thus, the base area of the cone-like membrane 122 is spaced away, in an axial direction, from the permanent magnet 121 a greater distance than the top face of the cone-like membrane 122.

The loudspeaker basket 123 is, at its radial outside, connected to an inside wall of the sound generator's 103 enclosure 131, and is further connected to a bell mouth 142. The bell mouth 142 is configured for being connected to the intake system and/or the exhaust system of a vehicle driven by an internal combustion engine via a port opening 132 of the sound generator 103 and a connecting pipe 141. Since also the attachment of the covering cap 124 on the membrane 122 and the attachment of the membrane 122 on the loudspeaker basket 123 by means of the surround 127 is implemented in an air-tight manner, the loudspeaker 102 thus divides the internal volume of the sound generator 103 in two portions hermetically sealed off from each other. Thus, the membrane 122, the surround 127, the cover cap 124, and the loudspeaker basket 123 seal off the voice coil carrier 125 with the voice coil 126 and the permanent magnet 121 hermetically from the corrosive exhaust gas.

Further, a membrane stop 150 made from polycaprolactam (polyamide 6) having a ball indenter hardness in the dry state according to DIN 53456 of 150 MPa is disposed between the membrane 122 and the loudspeaker basket 123, with the membrane stop being fixed to the loudspeaker basket 123. Thus, the membrane stop 150 can be located at the same side of the membrane 122 as the permanent magnet 121. The present invention is, however, not limited to a use of polycaprolactam of the hardness indicated. Alternatively, also a polycaprolactam showing a Young's modulus of 2,800 MPa in a bending test or a different synthetic material, and in particular a hard rubber may be used. The membrane stop 150 comprises a plurality of projections 151 arranged around the permanent magnet 121, with each projection having a contact surface 152 facing the membrane 122. With the membrane 122 being in its rest position, the contact surfaces 152 of all projections 151 of the membrane stop 150 are spaced apart from the membrane over their entire surface facing the membrane 122 by 5 mm. This distance corresponds to 2 percent of the maximum diameter of the membrane 122. When the membrane 122 is displaced excessively, the membrane 122 will thus hit the contact surfaces 152 of all projections 151 simultaneously, thereby preventing an excessive oscillation of the membrane 122.

Figure 4A:
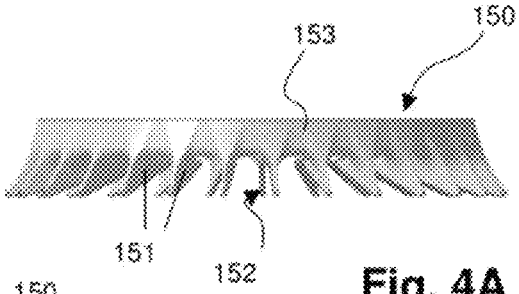
FIG. 4A is a schematic representation of a perspective side view of the membrane stop according to a first embodiment of the invention used in the sound generator of FIG. 3.
Figure 4D:
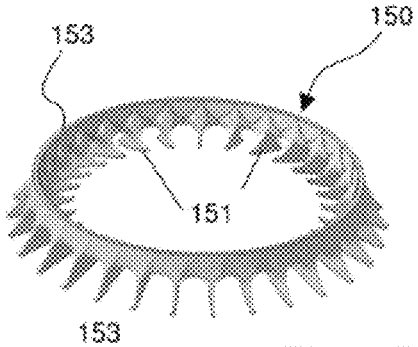
FIG. 4D is a schematic representation of a perspective view of the upside of the membrane stop of FIG. 4A at an angle.
Figure 4B:
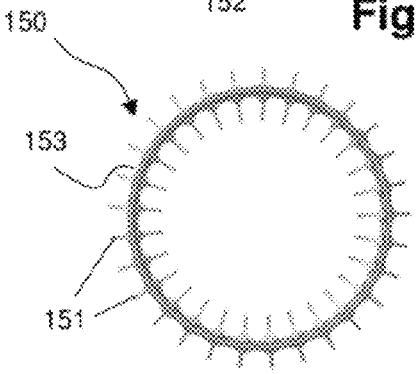
FIG. 4B is a schematic representation of a perspective view of the top of the membrane stop of FIG. 4A.
Figure 4C:
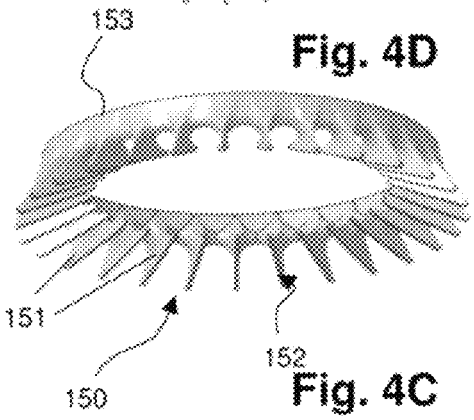
FIG. 4C is a schematic representation of a perspective view of the underside of the membrane stop of FIG. 4A at an angle.

In the following, the membrane stop 150 used in FIG. 3 will be explained in more detail with respect to FIGS. 4A to 4D. Hereby, FIG. 4A shows a perspective side view of the membrane stop 150, FIG. 4B a perspective top view, FIG. 4C a perspective view of the underside at an angle, and FIG. 4D a perspective view of the upside at an angle.

Referencing FIGS. 4A to 4D, the membrane stop 150 comprises twenty-nine projections 151 being evenly distributed over an angular range of 360° and formed integrally with the first ring portion 153 by injection molding. The first ring portion 153 serves an attachment of the membrane stop 150 on the loudspeaker basket 123. The sizes of the contact surfaces 152 of the projections 151 are chosen in the embodiment shown in FIGS. 3 and 4A-4D such that the contact surfaces 152 of all projections 151 together have a surface area amounting to 8 percent of the surface area of the membrane 122. For preventing damage to the membrane 120, the edges of the contact surface 152 are rounded and have in the embodiment shown a radius of 0.5 mm.

Referencing FIG. 3 in particular, the membrane stop 150 has a maximum diameter at the contact surfaces 152, whereby said maximum diameter corresponds to the maximum diameter of the membrane 122. The membrane stop 150 further has a minimum diameter at the contact surfaces 152, said minimum diameter being larger than the maximum diameter of the cover cap 124 and the voice coil carrier 125 located beneath it, and being 60 percent of the maximum diameter of the membrane 122 in the embodiment shown in FIGS. 3, 4A-4D. In the embodiment shown in FIGS. 3, 4A-4D, the extension of the contact surfaces 152 formed at the projections 151 of the membrane stop 150 in a radial direction is 8-times of that in the circumferential direction.

In the following, an alternative membrane stop 150', which may be used as an alternative to the membrane stop 150 shown in FIG. 3, is described referencing FIGS. 5A to 5C. The membrane stop 150' is hereby shown in FIG. 5A in a perspective side view, in FIG. 5B in a perspective top view, in FIG. 5C in a perspective view of the underside at an angle. Since this alternative membrane stop 150' is very similar to the membrane stop 150 shown in FIGS. 4A to 4D, only the differences will be explained in the following and for the rest it will be referred to the explanations provided above.

Figure 5A:
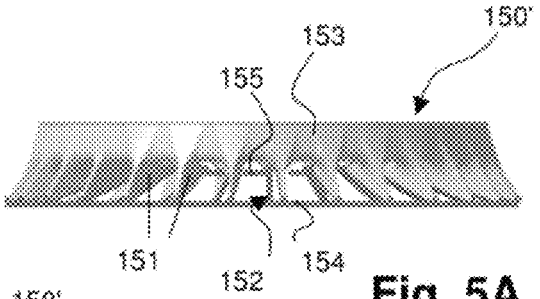
FIG. 5A is a schematic side representation of a membrane stop according to a second embodiment of the invention.
Figure 5B:
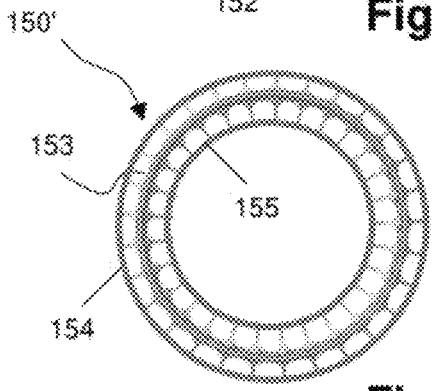
FIG. 5B is a schematic top representation of a membrane stop according to a second embodiment of the invention.
Figure 5C:
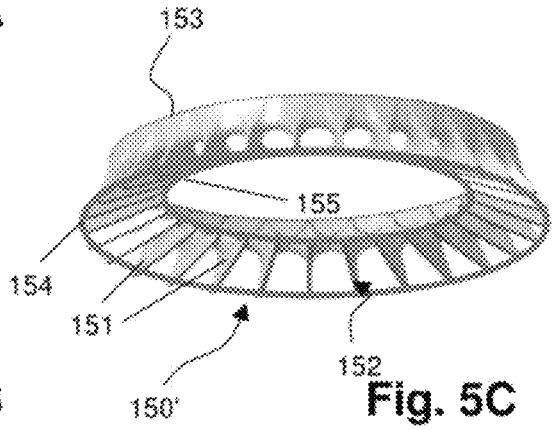
FIG. 5C is a schematic lower perspective representation of a membrane stop according to a second embodiment of the invention.

The alternative membrane stop 150' shown in FIGS. 5A to 5C has two ring portions 154, 155 formed integrally with the projections 151. These second ring portions 154, 155 have a material thickness of 4 mm and are arranged such their surface facing the membrane 122 in the mounted state of the membrane stop 150' is flush with the contact surfaces 152 of the projections 151. In the embodiment shown, the two second ring portions 154, 155 are located at the radial end sections of the contact surfaces 152, thus guaranteeing that no localized load of the membrane 122 occurs at these end sections, when the membrane 122 hits the contact surfaces 152.

Figure 6:
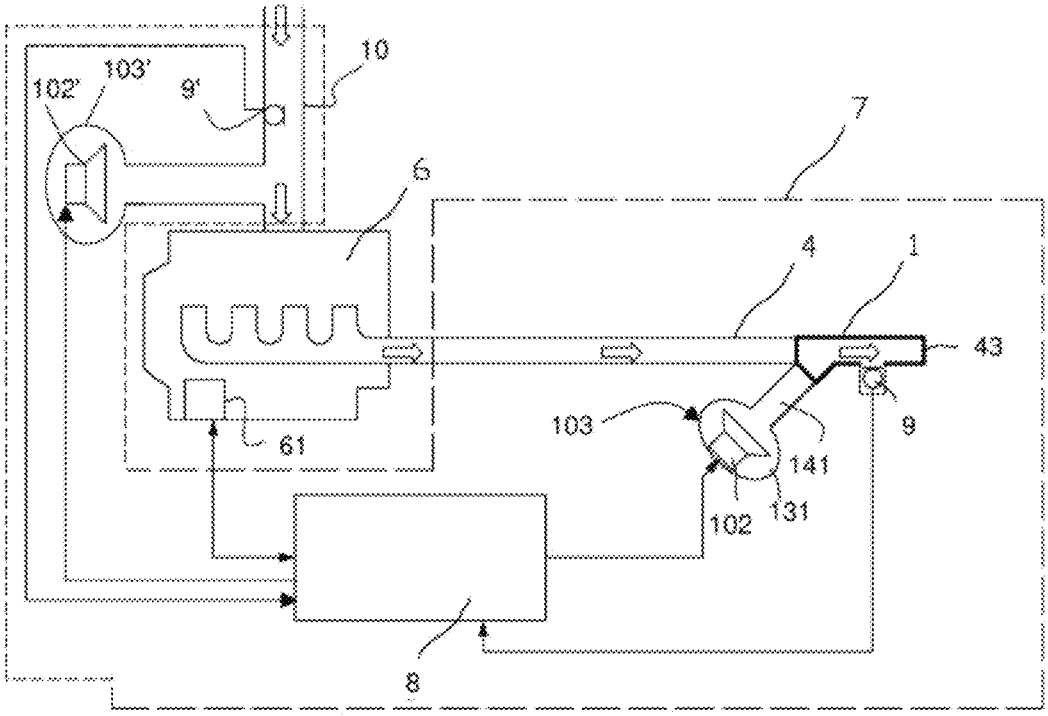
FIG. 6 is a schematic representation showing a block diagram of an anti-noise controller of an anti-noise system according to an embodiment of the present invention.

FIG. 6 shows a schematic representation of an anti-noise system 7 using the sound generator 103 described above.

A first sound generator 103 is connected to an exhaust system 4 of a vehicle via a Y-pipe 1 and a connecting pipe 141 in a region of a discharge opening (tailpipe) 43. At the discharge opening 43, exhaust gases traveling through the exhaust system 4 are discharged into the exterior.

A first error microphone 9 having the form of a pressure sensor is provided at the Y-pipe 1. The error microphone 9 measures pressure variations and thus noise inside the Y-pipe 1 in a section downstream of a region in which the fluid communication between the exhaust system 9 and the sound generator 103 is effected. It is, however, noted that the error microphone 9 is only optional.

A second sound generator 103' having a second loudspeaker 102' is connected to the intake system 10 of the vehicle. A second error microphone 9' is disposed in the intake system 10 upstream of a region where the fluid communication between the intake system 10 and the sound generator 103' is effected. Also here it is pointed out that the error microphone 9' is only optional.

The flow direction of the air flowing through the intake system 10 or of the exhaust gases flowing through the exhaust system 4 is indicated by arrows.

The loudspeaker 102, 102' of the sound generators 103, 103', and the error microphones 9, 9' are electrically connected to an anti-noise controller 8. The anti-noise controller 8 is further connected to the engine control unit 61 of an internal combustion engine 6 via a CAN data bus. It is noted that the present invention is not limited to a CAN data bus.

The exhaust system 4 may further comprise at least one catalytic converter (not shown) disposed between the internal combustion engine 6 and the Y-pipe 1 for cleaning the exhaust gases emitted from the internal combustion engine 6 and traveling through the exhaust system 4.

The general mode of operation of the above anti-noise system 7 is as follows:

Based on the noise measured by the error microphones 9, 9' and/or the operating parameters of the internal combustion engine 6 received via the CAN data bus, the anti-noise controller 8 calculates, using a Filtered-x Least Means Squares (FxLMS) algorithm, two digital control signals, each of which enable a substantial silencing of the noise propagating through the interiors of the intake system 10 or the exhaust system 4 by application of anti-noise, and outputs these to loudspeaker 102 or 102' of the respective sound generator 103 or 103'.

Figure 7:
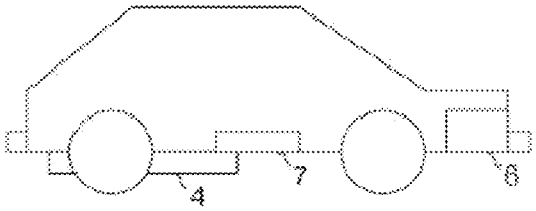
FIG. 7 is a schematic representation showing a motor vehicle having the anti-noise system according to the invention incorporated therein.

In the schematic representation of FIG. 7 a motor vehicle is shown, having an internal combustion engine 6, an exhaust system 4, and the above anti-noise system 7. The sound generator and the loudspeaker of the anti-noise system are not expressly shown in FIG. 7.

For the sake of clarity, only those elements, components, and functions beneficial for an understanding of the present invention are shown in the Figures. Embodiments of the invention are, however, not limited to elements, components, and functions shown, but may contain further elements, components, and functions if necessary for their usage or range of functions.

While the disclosure has been described with respect to certain exemplary embodiments thereof, it is evident that many alternatives, modifications and variations will be apparent to those skilled in the art. Accordingly, the exemplary embodiments of the disclosure set forth herein are intended to be illustrative and not limiting in any way. Various changes may be made without departing from the spirit and scope of the present disclosure as defined in the following claims.

What is claimed is:

1. A sound generator for an anti-noise system for influencing sound waves propagating through an intake system or an exhaust system of vehicles driven by an internal combustion engine, the sound generator comprising:

a loudspeaker basket;

a membrane supported by the loudspeaker basket;

a permanent magnet supported by the loudspeaker basket;

a voice coil carrier supported by the membrane;

a voice coil supported by the voice coil carrier, the voice coil being disposed in a constant magnetic field created by the permanent magnet; and a membrane stop, wherein:

the membrane stop is located on the loudspeaker basket adjacent to the membrane; and the membrane stop comprises a projection extending towards the membrane.

2. The sound generator according to claim 1, wherein:

the projection comprises a contact surface facing the membrane forming all or a portion of a total membrane stop contact surface area; and the total membrane stop contact surface area is more than 2 percent and less than 15 percent of a surface area of the membrane.

3. The sound generator according to claim 2, wherein the projection contact surface has a larger extension in a radial direction than in a circumferential direction.

4. The sound generator according to claim 2, wherein:

the membrane stop comprises at least another projection, with a contact surface facing the membrane, to provide a plurality of projections;

each contact surface is spaced apart from the membrane, with the membrane in a rest position, by a rest position contact surface spacing distance;

the rest position contact surface spacing distance is constant for an overall length of each contact surface; and the rest position contact surface spacing distance is equal for all of the projections.

5. The sound generator according to claim 1, wherein:

the membrane stop comprises at least another projection to provide a plurality of projections, each with a contact surface facing the membrane;

each contact surface is spaced apart from the membrane, with the membrane in a rest position, by a rest position contact surface spacing distance;

the rest position contact surface spacing distance is constant for an overall length of each contact surface; and the rest position contact surface spacing distance is equal for all of the projections.

6. The sound generator according to claim 5, wherein the rest position contact surface spacing distance is at least 3 mm.

7. The sound generator according to claim 5, wherein the rest position contact surface spacing distance is at least 2 percent of a maximum diameter of the membrane.

8. The sound generator according to claim 1, wherein the membrane stop has at least one of:

an open inner diameter larger than a maximum diameter of the voice coil carrier; and a maximum outer diameter smaller than a maximum diameter of the membrane.

9. The sound generator according to claim 1, wherein the membrane stop comprises at least another projection, with a contact surface facing the membrane, to provide a plurality of projections and at least one of:

the plurality of projections are spaced apart and disposed over an angular range of 360° around the permanent magnet;

the plurality of projections are spaced apart and regularly disposed over an angular range of 360° around the permanent magnet and the plurality of projections comprise twenty-four projections disposed over an angular range of 360° around the permanent magnet; and the plurality of projections comprise twenty-four projections regularly disposed over an angular range of 360° around the permanent magnet.

10. The sound generator according to claim 1, wherein the membrane stop further comprises a ring fixed to the loudspeaker basket concentrically with respect to the permanent magnet, the ring supporting the projection.

11. The sound generator according to claim 10, wherein the membrane stop further comprises a second ring, disposed concentrically with respect to the permanent magnet, the second ring being supported by the projection, the second ring forming a contact surface for the membrane that is spaced apart from the loudspeaker basket.

12. The sound generator according to claim 1, wherein the membrane stop is formed integrally with the loudspeaker basket or is a separate component fixed to the loudspeaker basket.

13. The sound generator according to claim 1, wherein the membrane stop is located at the same side of the membrane as the permanent magnet and the voice coil carrier.

14. The sound generator according to claim 1, wherein the membrane stop is formed in one piece from synthetic material or metal.

15. The sound generator of claim 1, wherein the membrane stop has at least one of:

a Shore-D hardness of between 50 and 95;

a Shore-D hardness of between 70 and 80;

a Young's modulus of more than 0.2 Gpa;

a Young's modulus of more than 1 Gpa;

a Young's modulus of more than 10 GPa;

a shear modulus of more than 0.05 Gpa;

a shear modulus of more than 0.1 Gpa; and a shear modulus of more than 10 GPa.

16. The sound generator according to claim 1, wherein the membrane stop is inelastic.

17. The sound generator according to claim 1, further comprising:

a surround; and an enclosure supporting the loudspeaker basket, the enclosure comprising a port opening for a fluid communication with the exhaust system or intake system, respectively, wherein:

the membrane is funnel-shaped or dome-shaped with an axial extent, from a membrane base to a membrane top, and having a base radial dimension that is larger than a top radial dimension with the membrane base being spaced away, in an axial direction, from the permanent magnet a greater distance than the membrane top; and the membrane is coupled to the loudspeaker basket by the surround.

18. The sound generator according to claim 1, wherein:

the membrane stop comprises at least another projection to provide a plurality of projections, each with a contact surface facing the membrane;

the membrane stop has an open inner diameter larger than a maximum diameter of the voice coil carrier and a maximum outer diameter smaller than a maximum diameter of the membrane; and the plurality of projections are spaced apart and regularly disposed, over an angular range of 360°, around the permanent magnet.

19. An anti-noise system for at least one of an intake system and an exhaust system of a vehicle driven by an internal combustion engine, the anti-noise system comprising:

an anti-noise controller; and a sound generator comprising:

a loudspeaker basket;

a membrane supported by the loudspeaker basket;

a permanent magnet supported by the loudspeaker basket;

a voice coil carrier supported by the membrane;

a voice coil supported by the voice coil carrier, the voice coil being disposed in a constant magnetic field created by the permanent magnet; and a membrane stop, wherein:

the membrane stop is located on the loudspeaker basket adjacent to the membrane;

the membrane stop comprises a projection extending towards the membrane;

the voice coil of the at least one sound generator is operatively connected to the anti-noise controller; and the anti-noise controller is configured for generating at least one control signal and outputting the least one control signal to the voice coil of the sound generator, with the control signal being adapted to cancel noise inside at least one of the intake system and the exhaust system at least in part in magnitude when the voice coil of the at least one sound generator is operated with the control signal.

20. A motor vehicle, comprising:

an internal combustion engine with an engine control unit;

an intake system in fluid communication with the internal combustion engine and an exhaust system in fluid communication with the internal combustion engine; and anti-noise system comprising:

an anti-noise controller; and a sound generator comprising:

a loudspeaker basket;

a membrane supported by the loudspeaker basket;

a permanent magnet supported by the loudspeaker basket;

a voice coil carrier supported by the membrane;

a voice coil supported by the voice coil carrier, the voice coil being disposed in a constant magnetic field created by the permanent magnet; and a membrane stop, wherein:

the membrane stop is located on the loudspeaker basket adjacent to the membrane;

the membrane stop comprises a projection extending towards the membrane;

the voice coil of the at least one sound generator is operatively connected to the anti-noise controller; and the anti-noise controller is configured for generating at least one control signal and outputting the least one control signal to the voice coil of the sound generator, with the control signal being adapted to cancel noise inside at least one of the intake system and the exhaust system at least in part in magnitude when the voice coil of the at least one sound generator is operated with the control signal;

the sound generator is in fluid communication with at least one of the intake system and the exhaust system; and the anti-noise controller is electrically connected to the engine control unit of the internal combustion engine of the vehicle.

* * * * *